US007695634B2

(12) United States Patent
Hesse et al.

(10) Patent No.: US 7,695,634 B2
(45) Date of Patent: Apr. 13, 2010

(54) COLLECTOR FOR SULFIDIC ORES

(75) Inventors: Heinrich Hesse, Hattersheim (DE); Tobias Rau, Mainz (DE); Wolfgang Buch, Frankfurt am Main (DE); Jaime Gomez, Santiago de Chile (CL); Miguel Angel Arends, Santiago de Chile (CL); Norbert Ernstorfer, Santiago de Chile (CL)

(73) Assignee: Clariant Produkte (Deutschland) GmbH, Sulzbach (DE)

( * ) Notice: Subject to any disclaimer, the term of this patent is extended or adjusted under 35 U.S.C. 154(b) by 671 days.

(21) Appl. No.: 11/596,171

(22) PCT Filed: Apr. 28, 2005

(86) PCT No.: PCT/EP2005/004534

§ 371 (c)(1),
(2), (4) Date: Nov. 10, 2006

(87) PCT Pub. No.: WO2005/113152

PCT Pub. Date: Dec. 1, 2005

(65) Prior Publication Data

US 2007/0221878 A1 Sep. 27, 2007

(30) Foreign Application Priority Data

May 10, 2004 (DE) ..... 10 2004 022 925

(51) Int. Cl.
*B03D 1/01* (2006.01)
*B03D 1/02* (2006.01)
*B03D 1/006* (2006.01)
*B03D 1/008* (2006.01)
*B03D 1/012* (2006.01)

(52) U.S. Cl. ..... 252/61; 75/749; 209/166

(58) Field of Classification Search ..... 252/61; 209/166

See application file for complete search history.

(56) References Cited

U.S. PATENT DOCUMENTS

| | | | |
|---|---|---|---|
| 2,875,896 A | 3/1959 | Last | |
| 4,178,235 A | 12/1979 | Wilson | |
| 4,699,711 A | 10/1987 | Bergman | |
| 2004/0099836 A1 | 5/2004 | Hesse | |

FOREIGN PATENT DOCUMENTS

| | | | |
|---|---|---|---|
| GB | 798768 | | 7/1958 |
| GB | 798769 | | 7/1958 |
| GB | 826827 | | 1/1960 |
| GB | 887469 | | 1/1962 |
| SU | 607597 | * | 3/1978 |
| WO | WO 02/38277 | | 5/2002 |

OTHER PUBLICATIONS

Mukai et al., Copper silicate mineral flotation by activation with organic copper reagents, 1975, Proceedings of the International Mineral Processing Congress, 11th issue, 671-689.*

Ackerman et al., Use of chelating agents in the flotation of copper sulfides and pyrite, 1999, vol. 16, issue 1, p. 27-35.*

PCT International Search Report for PCT/EP2005/004535, mail dated Feb. 8, 2007.

English Translation of PCT International Preliminary Report on Patentability for PCT/EP2005/004535, mail dated Feb. 8, 2007.

* cited by examiner

*Primary Examiner*—Jerry Lorengo
*Assistant Examiner*—Jared Wood
(74) *Attorney, Agent, or Firm*—Tod A. Waldrop

(57) ABSTRACT

The present invention relates a flotation reagent for sulfidic ores, containing at least one compound of formula (1), wherein $R^2$, $R^3$, $R^4$, $R^5$, $R^6$ and $R^7$, independent of one another, represent hydrogen or groups containing 1 to 15 carbon atoms or groups containing oxygen or nitrogen, and at least another compound serving as collector and containing at least one sulfur atom that is directly bound to a carbon or phosphorus atom, wherein the carbon or phosphorus atom is directly bound to at least another sulfur atom or an oxygen atom.

(1)

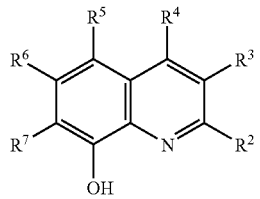

11 Claims, No Drawings

COLLECTOR FOR SULFIDIC ORES

The present invention is described in the German priority application No. 10 2004 022 925.2, filed 10 May 2004, which is hereby incorporated by reference as is fully disclosed herein.

The present invention relates to the use of collectors in the dressing of sulfidic ores by flotation.

In the production by flotation of sulfidic ores, in particular copper ores or molybdenum ores, use is made commercially of various collector types, such as dithiophosphates, xanthates, xanthogen formates, and thionocarbamates (Schubert: Aufbereitung fester mineralischer Rohstoffe [Dressing of solid mineral raw materials], volume 11, 1977, pp. 296 ff.] and also their mixtures in combination with frothers. The flotation process separates, for example, copper and molybdenum sulfides from gangue minerals.

Collectors cause wetting of the surface of the mineral of value which leads to hydrophobization of the mineral particles. Injecting air into the aqueous flotation pulp produces air bubbles to which the hydrophobized mineral particles adhere and are discharged by these to the surface of the flotation pulp. The suspended mineral of value, termed concentrate, is skimmed off, while gangue minerals remain in the pulp.

Frothers are added to modify the foam formation. Commercially conventional frothers include, for example, alcohols, polypropylene glycols, and also their ethers and MIBC (methyl isobutyl carbinol).

U.S. Pat. No. 4,699,711 discloses a method for the flotation of sulfide minerals using preferably short-chain alkyl-substituted thionocarbamates.

WO-02/38277 discloses the use of mixtures of thionocarbamates and mercaptobenzothiazoles as collectors for the flotation of sulfidic ores, in particular copper ore which is associated with molybdenum and gold.

GB-A-798 769 and U.S. Pat. No. 4,178,235 describe the flotation of niobium minerals using 8-quinolinol and 5-hydroxyquinolin, respectively. GB-A-826 827 describes, in addition to 8-quinolinol, alkyl-substituted 8-quinolinol derivatives for the flotation of niobium minerals.

8-Quinolinol has a high affinity to metal ions and forms complexes with these, termed oxinates. 8-Quinolinol is therefore also used as precipitation reagent for various metal ions.

GB-A 887 469 describes a method for recovering 8-quinolinol after use.

When pyrite-containing ores are dressed by flotation at pHs below 10 using commercially conventional sulfidic collectors such as dialkyl dithio-phosphates, xanthates, dialkyl xanthoformates or dialkyl thionocarbamates, concentrates having relatively high pyrite concentrations are obtained. In this case the dialkyl thionocarbamates are even considered as very selective in relation to pyrite in comparison with xanthates and dithio-phosphates.

This high pyrite fraction, has an adverse consequence in the subsequent further processing of the concentrate. Firstly, the efficacy of the reduction process is decreased, and high amounts of sulfur oxides are formed which pollute the environment, or their disposal gives rise to high costs.

To decrease the pyrite fraction in the concentrate, and increase the content of mineral of value, lime is added to the flotation pulp which, depending on the amount, raises the pH of the flotation pulp to above 10. The amounts of added lime vary, depending on pyrite content, between 0 and several kg per tonne of ore feed. The lime thus substantially contributes to the reagent costs of the flotation process. A reduction in the amount of lime and decrease in pH to below 10 would therefore not only contribute to reducing the sulfur oxide emissions to the environment, but also would be accompanied by a saving in reagent costs.

It was an object of the present invention to find an improved collector type for sulfidic ores which yields better flotation results than collectors of the prior art. It is additionally an object of the invention to reduce the required amounts of pH modifiers, in particular lime, which is used for pH elevation and for lowering pyrite.

Surprisingly, it has been found that using 8-hydroxyquinolinol derivatives in combination with conventional collectors in the flotation of sulfidic ores causes a marked improvement in the flotation results. In particular, by combining 8-quinolinol with conventional collectors, a marked improvement in the flotation of pyrite-containing copper ores was achieved. Especially in combination with thionocarbamates, a marked improvement in the flotation of copper ore using 8-quinolinol was established.

The invention thus relates to a flotation reagent for sulfidic ores, which flotation reagent comprises at least one compound of the formula (1)

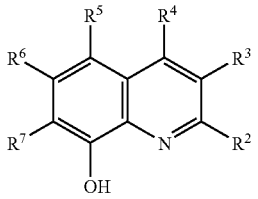

(1)

where $R^2$, $R^3$, $R^4$, $R^5$, $R^6$ and $R^7$, independently of one another are hydrogen or groups comprising 1 to 15 carbon atoms, or groups comprising oxygen or nitrogen, and at least one further compound acting as collector for sulfidic ores.

Preferably, the collector for sulfidic ores is a compound which comprises at least one sulfur atom which is directly bound to a carbon or phosphorus atom, and this carbon or phosphorus atom being directly bound to at least one further sulfur atom or to a nitrogen atom, or to an oxygen atom.

The invention further relates to the use of the inventive flotation reagent for the flotation of sulfidic ores.

The invention further relates to a method for the flotation of sulfidic ores by bringing the inventive flotation reagent into contact with the sulfidic ores.

The invention further relates to the use of compounds of the formula 1 as additive to collectors for sulfidic ores.

Using the inventive flotation reagent, in the flotation of metal sulfides, improved results in selectivity and yield can be achieved compared with standard collectors. The properties of the further collector which are already selective in relation to pyrite can be further significantly improved by using compounds of the formula (1). In particular, ores which have a high pyrite fraction and are customarily flotated at a pH above 10 can be flotated even at pHs of 7 to 10, for example at pH 8.5 to 9.0. In this case the co-flotated pyrite fraction in the resultant concentrate is markedly lower than using currently available collectors at the same pH, or the mineral value content is higher.

The sulfidic ores are preferably copper-containing ores which have pyrite fractions up to 90% by weight.

It is possible to flotate all metal sulfides and metals (apart from Fe), with Cu, Mo, Pb, Zn, Co, Au, Ag, Pt and Ni being particularly preferred. Particularly good results are observed in the dressing of Cu and Mo. The inventive flotation reagent can be used in a wide pH range, for example 2 to 12, preferably 5 to 12, and is added to the aqueous pulp at a concentration preferably between 0.001 and 1.0 kg/tonne of crude ore.

The compounds of the formula (1), in a preferred embodiment, are those where $R^2$, $R^3$, $R^4$, $R^5$, $R^6$ and $R^7$ independently of one another are H or $C_1$- to $C_4$-alkyl, in particular all H.

The further collectors, in preferred embodiments, are those compounds which structural units of the formulae (2)

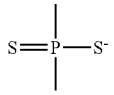

(3)

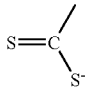

(4)

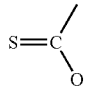

(5)

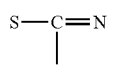

where the free valencies are saturated by organic radicals or sulfur atoms.

In particularly preferred embodiments, the further collectors are dithiophosphates of the formula (6)

(6)

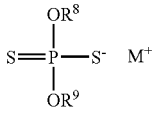

or xanthates of the formula (7)

(7)

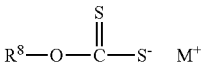

or xanthogen formates of the formula (8)

(8)

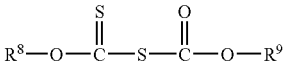

or thionocarbamates of the formula 9

(9)

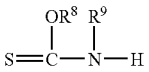

or mercaptobenzothiazoles of the formula 10

(10)

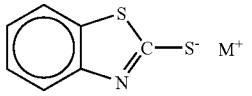

where $R^8$ and $R^9$ independently of one another are hydrocarbon radicals having 1 to 10 carbon atoms, in particular $C_1$- to $C_{10}$-alkyl, $C_1$- to $C_{10}$-alkenyl, $C_1$- to $C_5$-alkyl, $C_1$- to $C_5$-alkenyl, phenyl, benzyl or naphthyl, and $M^+$ is a cation, in particular a metal ion or an ammonium ion.

The mixing ratio of the compounds of the formula 1 to the further collectors which are represented by the formulae 2 to 10 is preferably 0.1:99.9 to 20:80, in particular 1:99 to 10:90. In a preferred embodiment, the inventive flotation reagent comprises between 0.1 and 20% by weight of 8-quinolinol.

Using the inventive flotation reagent, a significant improvement of yield and selectivity are achieved compared with the collectors of the prior art. Examples 1 to 6 clearly show that the yield of copper and molybdenum is higher than using the corresponding standard reagent.

By using the inventive reagent together with a thionocarbamate, at pHs between 8.5 and 10.5, copper concentrates having 5 to 9% higher copper concentrations are obtained than using a conventional thionocarbamate. The copper yield is also significantly improved between 0.9 and 2.4 percentage points.

EXAMPLES

The table below shows the flotation results of the inventive collector compared with the standard reagent. Laboratory flotation experiments were carried out on a Chilean copper ore. As standard reagent (comparative examples 4 to 6), use was made of an ethylthio, O-isopropylthiono carbamate and a dosage of 14 g/t of crude ore feed. A commercially conventional frother (MIBC) was added at a dosage of 15 g/t of ore feed. The invention is shown in the examples (examples 1 to 3). It corresponds to the 94.4% strength ethylthio-, O-isopropoylthionocarbamate at an addition of 5.6% 8-quinolinol. The resultant values for the copper content and the yield are means in each case of three individual flotations.

TABLE 1

Efficacy of the inventive collectors compared with the prior art

| Example | pH | Content of Cu, % | Yield of Cu, % |
|---|---|---|---|
| 1 | 8.5 | 10.8 | 93.4 |
| 2 | 9.5 | 11.1 | 92.8 |
| 3 | 10.5 | 11.2 | 92.2 |
| 4 (C) | 8.5 | 9.9 | 91.0 |
| 5 (C) | 9.5 | 10.3 | 91.6 |
| 6 (C) | 10.5 | 10.7 | 91.3 |

The results show a generally increased percentage yield and also a higher content of Cu due to the inventive flotation reagent.

The invention claimed is:

1. A flotation reagent for sulfidic ores, which flotation reagent comprises a compound of the formula (1)

(1)

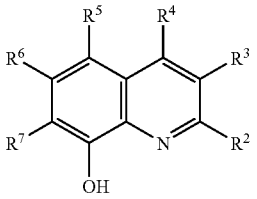

where $R^2$, $R^3$, $R^4$, $R^5$, $R^6$ and $R^7$, independently of one another are hydrogen or groups comprising 1 to 15 carbon atoms, or groups comprising oxygen or nitrogen, and at least one collector compound acting as collector for sulfidic ores which comprises at least one sulfur atom which is directly bound to a carbon or phosphorus atom, and this carbon or phosphorus atom being directly bound to at least one further sulfur atom or a nitrogen atom or an oxygen atom, the mixing ratio of the compound of the formula 1 to the at least one collector compound being 0.1:99.9 to 10:90.

2. The flotation reagent as claimed in claim 1, wherein the collector compound is selected from a compound which having a structural unit selected from the group consisting of formula (2), formula (3), formula (4), and formula (5)

(2)

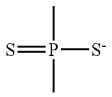

(3)

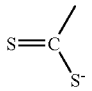

(4)

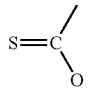

(5)

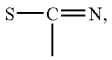

where the free valencies of said compound are saturated by organic radicals or sulfur atoms.

3. The flotation reagent as claimed in claim 1, comprising 8-quinolinol.

4. The flotation reagent as claimed in claim 2, wherein the further collector is selected from a dithiophosphate of the formula 6

(6)

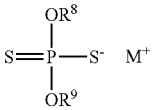

or a xanthate of the formula (7)

(7)

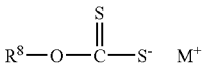

or a xanthogen formate of the formula 8

(8)

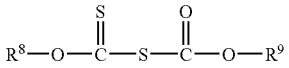

or a thionocarbamate of the formula 9

(9)

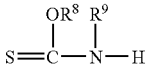

or a mercaptobenzothiazole of the formula 10

(10)

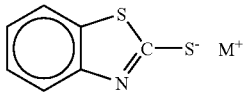

where $R^8$ and $R^9$ independently of one another are hydrocarbon radicals having 1 to 10 carbon atoms, and $M^+$ is a cation.

5. The flotation reagent of claim 4, wherein $R^8$ and $R^9$ independently are selected from the group consisting of $C_1$- to $C_{10}$-alkyl, $C_1$- to $C_{10}$-alkenyl, $C_1$- to $C_5$-alkyl, $C_1$- to $C_5$-alkenyl, phenyl, benzyl, and naphthyl.

6. The flotation reagent of claim 4, wherein $M^+$ is a metal ion or an ammonium ion.

7. A method for the flotation of crude sulfidic ore, said method comprising contacting the crude sulfidic ore with the flotation reagent of claim 1 in amounts of 0.001 to 1.0 kg per tonne of crude ore for the flotation of sulfidic ores and metals.

8. The method of claim 7, wherein the crude sulfidic ore is selected from the group consisting of copper sulfide, nickel sulfide, zinc sulfide, lead sulfide, molybdenum sulfide, and mixtures thereof.

9. The method of claim 7, wherein the crude sulfidic ore comprises between 0 and 90% pyrite.

10. The method of claim 7, wherein the crude sulfidic ore is a copper ore.

11. The method of claim 7, wherein the flotation-reagent has a pH range of 7 to 10.

* * * * *